US005430981A

United States Patent [19]

Scott

[11] Patent Number: 5,430,981

[45] Date of Patent: Jul. 11, 1995

[54] DEVICE FOR INSTALLING DECORATIVE PANELS IN FRONT OF EXISTING WINDOW PANES

[76] Inventor: John T. Scott, 23389 Continental, Canyon Lake, Calif. 92587

[21] Appl. No.: 197,238

[22] Filed: Feb. 16, 1994

Related U.S. Application Data

[63] Continuation of Ser. No. 92,506, Jul. 15, 1993, abandoned, which is a continuation of Ser. No. 833,103, Feb. 10, 1992, abandoned.

[51] Int. Cl.[6] ..... E06B 3/00; E04B 1/38

[52] U.S. Cl. ..... 52/202; 52/203; 52/213; 52/314; 52/708

[58] Field of Search ..... 52/202, 203, 207, 213, 52/766, 76 E, 314, 704, 708, 202, 489.1; 49/61, 62, 463; 428/38

[56] References Cited

U.S. PATENT DOCUMENTS

| | | | |
|---|---|---|---|
| 915,588 | 3/1909 | Gehret . | |
| 1,800,075 | 4/1931 | Imrie | 248/300 |
| 2,191,500 | 2/1940 | Rosling . | |
| 2,228,358 | 1/1941 | Lowry . | |
| 2,246,075 | 6/1941 | Phillips et al. . | |
| 2,711,789 | 6/1955 | Boyle et al. | 160/106 |
| 2,716,783 | 9/1955 | Fegan . | |
| 3,226,781 | 1/1966 | Schnabel | 52/213 X |
| 3,360,893 | 1/1968 | Wattelez . | |
| 4,089,143 | 5/1978 | La Pietra . | |
| 4,121,379 | 10/1978 | Everson | 49/61 |
| 4,134,240 | 1/1979 | Bologna et al. . | |
| 4,215,517 | 8/1980 | Everson | 52/202 |
| 4,233,790 | 11/1980 | Meadows . | |
| 4,320,609 | 3/1982 | Abell . | |
| 4,351,137 | 9/1982 | Enyart et al. . | |
| 4,416,096 | 11/1983 | Shuster et al. . | |
| 4,648,221 | 3/1987 | Häggovist . | |
| 4,680,915 | 7/1987 | Bush . | |
| 4,685,261 | 8/1987 | Seaquist . | |
| 5,086,604 | 2/1992 | Orth | 52/202 X |

FOREIGN PATENT DOCUMENTS

| | | | |
|---|---|---|---|
| 1100917 | 3/1961 | Germany | 52/202 |

*Primary Examiner*—Carl D. Friedman
*Assistant Examiner*—Robert J. Canfield
*Attorney, Agent, or Firm*—Leonard Tachner

[57] ABSTRACT

A channel clip which is configured to hold glass or plastic decorative panels in front of single or dual pane windows without affecting the existing window glass and while permitting a spaced and secure relationship between the decorative panel and the inner-most window pane in the proximity of which the decorative panel is installed. In a preferred embodiment herein, the channel clip of the present invention is a transparent, injection-molded polycarbonate device having three integrated structural members including a base member and a pair of panel retaining members. The retaining members are positioned preferably in perpendicular relationship to the base member and in spaced apart parallel relation to one another. A gap formed therebetween is adapted to receive the designer panel. The base member preferably is provided with a countersunk or tapered aperture which is designed to accommodate a wood screw to secure the channel clip into the underlying surface adjacent the window pane.

5 Claims, 2 Drawing Sheets

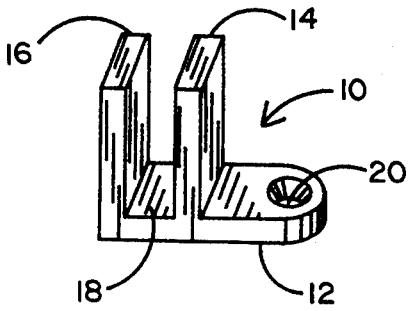
FIG. 1
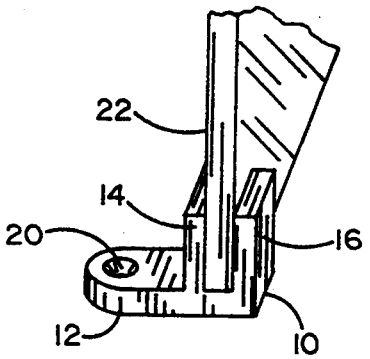
FIG. 2
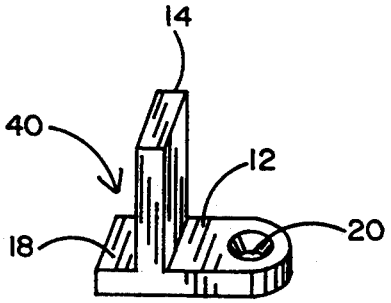
FIG. 4
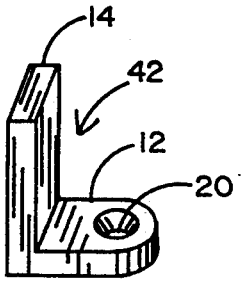
FIG. 5
FIG. 3
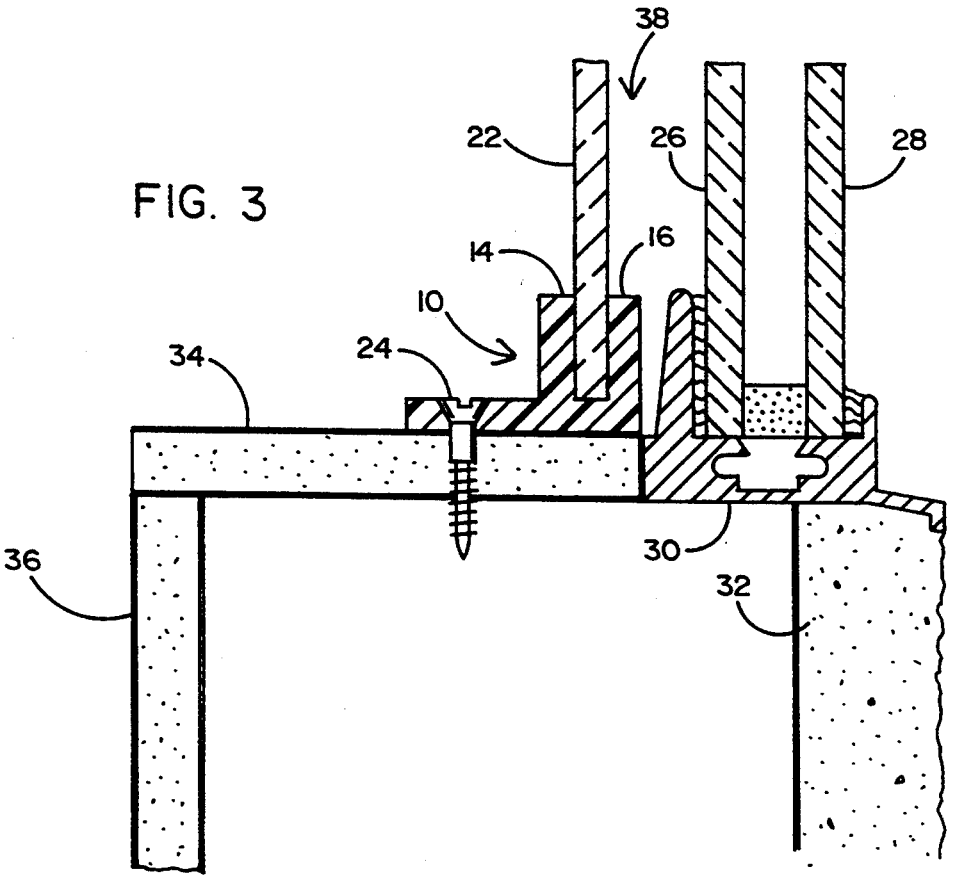

DEVICE FOR INSTALLING DECORATIVE PANELS IN FRONT OF EXISTING WINDOW PANES

This is a continuation of application Ser. No. 08/092,506 filed on Jul. 15, 1993 which is a continuation of Ser. No. 07/833,103 filed on Feb. 10, 1992, both abandoned.

BACKGROUND OF THE INVENTION

1. Field of the Invention

The present invention relates generally to devices to facilitate the installation of designer glass or plastic panels in front of existing single or dual pane windows and more specifically to a channel clip configured to facilitate holding such glass or plastic designer panels without affecting existing window glass to which the designer glass is installed in adjacent relationship.

2. Prior Art

As used herein, the term "designer glass" includes, but is not necessarily limited to, stained glass or plastic panels bearing an artistic design, such panels being configured to overlay existing window panes in parallel spaced relation therewith for creating an aesthetically pleasing stained glass window without requiring substitution of the designer panel for the existing window glass.

The concept of employing a stained glass overlay to create the effect of a stained glass window is old in the art. Unfortunately however, there has been no convenient and standard way of facilitating installation of such designer glass panels in relation to the existing window panes. As a result, installers have used various types of adhesive to adhere the designer glass directly to the inner-most surface of the existing window pane, or a variety of arbitrarily configured and homemade brackets designed to compress the designer panel into abutting relation with the inner-most window pane of the existing window. Both of these existing or prior art techniques are unsatisfactory in one way or another. Directly adhering the designer panel to the inner-most window tends to make the installation of the designer panel a permanent one, without permitting the removal of the designer panel, such as when an apartment or house dweller changes residences and wishes to take the designer panel with him or her. Even installation with brackets where the designer panel is configured for abutting relation with the inner-most window pane of the existing window is unsatisfactory because it has been found advantageous to permit air flow between the designer panel and the existing window panes. Such air flow is particularly desirable when the window is subjected to significant temperature change, such as due to incident sunlight particularly during summer months.

There has therefore been a long felt need for a device which facilitates the installation of designer panels in front of single or dual pane windows without affecting existing window glass and without requiring either an adhesive bond between the designer panel and the existing window pane or any other form of mechanically induced abutting relationship between the designer panel and the window pane which would otherwise preclude the free flow of air therebetween.

The following U.S. patents disclose subject matter which is relevant to the present invention, but which does not preclude the patentability thereof.

U.S. Pat. No. 915,588 Gehret

U.S. Pat. No. 2,191,500 Rosling
U.S. Pat. No. 2,228,858 Lowry
U.S. Pat. No. 2,246,075 Phillips et al
U.S. Pat. No. 2,716,783 Fegan
U.S. Pat. No. 3,360,893 Wattelez
U.S. Pat. No. 4,089,143 La Pietra
U.S. Pat. No. 4,134,240 Bologna et al
U.S. Pat. No. 4,233,790 Meadows
U.S. Pat. No. 4,320,609 Abell
U.S. Pat. No. 4,351,137 Enyart et al
U.S. Pat. No. 4,416,096 Schuster et al
U.S. Pat. No. 4,648,221 Haggqvist
U.S. Pat. No. 4,680,915 Bush
U.S. Pat. No. 4,685,261 Seaquist U.S. Pat. No. 2,716,783 to Fegan is directed to a double window arrangement which allows for a supplementary sheet of glass to be secured in spaced relationship to the window frame opening. In the invention described, the supplementary window or pane is fastened using clip devices. FIGS. 5, 6, 7, 8 and 9 show various views of the clips used and various forms thereof. These clips may be mounted using screws through holes. The clip in FIG. 9, shows a projection giving rise to a groove to receive the pane. FIG. 1 shows a plurality of clips secured in position to hold the supplementary pane. In each cased the added window sheet rests on a "distance piece" which is separate from the clip.

U.S. Pat. No. 2,191,500 to Rosling is directed to a system for installing a supplementary window pane on windows, doors, and the like. This invention utilizes strips as opposed to individual clips. Utilization of the molding or clip may be seen in FIG. 3, showing the clip, with a channel holding a pane. An Extended portion with a screw hold provides for mounting of the clip. FIGS. 4 and 5 show alternative versions of this mounting device, providing for extension from and positioning of the window pane at various distances from the permanently fixed members. The utilization of these clips allows for the mounting of a supplementary window pane or decorative panel in any location and is not necessarily restricted to association with an installed window or door.

U.S. Pat. No. 3,360,893 to Wattelez is directed to a framing element for mounting panels on a frame such as a door or window. In FIG. 5, one may see the use of this framing element mounted with screws or nails, and holding a pane in spaced relationship to a permanently mounted window. This device would allow for the mounting of plastic designer panels in front of single or dual pane windows without affecting the existing window structure.

U.S. Pat. No. 4,351,137 to Enyart et al is directed to a mounting frame for a plastic panel which may be utilized with a standard installed window or separated therefrom, if so desired. The details of this framing element are best seen in FIG. 2, showing frames of various thicknesses being held in position by interlocking members of said device. An anchor fits into a channel for locking the window pane into position. Adhesive is made available to attach framing member to the window frame or to other framing material for location of a supplementary decorative panel.

U.S. Pat. No. 2,228,358 to Lowry is directed to a double glazed window construction designed to accommodate glass sheets or panes in different thicknesses and such that one of the sheets or panes may be readily removed from the window without necessitating removal of the other sheet or pane, and the corresponding mounting devices. Referring to FIG. 2, one may see the outer sash mounted with a pane. The means for clamping the glass sheet against an outer member includes an L-shaped clamping member having a horizontal base and a vertical flange. The clamping member is secured to the ledge by screws which pass through slots in the base of said clamping member. When securing the glass sheet in place, the sheet is first moved into engagement with the outer member and the clamping member is then moved inwardly against the glass sheet and a rib thereof .engaged between two teeth. The screws are then tightened to cause the desired clamping pressure to be exerted upon the glass sheet. The provision of teeth and slots through which the fastening screws pass, permits the use of glass sheets of different thicknesses.

SUMMARY OF THE INVENTION

The present invention comprises a channel clip which is configured to hold glass or plastic decorative panels in front of single or dual pane windows without affecting the existing window glass and while permitting a spaced and secure relationship between the decorative panel and the inner-most window pane in the proximity of which the decorative panel is installed. In a preferred embodiment herein, the channel clip of the present invention is a transparent injection-molded polycarbonate device having three integrated structural members including a base member and a pair of panel retaining members. The retaining members are positioned preferably in perpendicular relationship to the base member and in spaced apart parallel relation to one another. A gap formed therebetween is adapted to receive the designer panel. The base member preferably is provided with a countersunk or tapered aperture which is designed to accommodate a wood screw to secure the channel clip into the underlying surface adjacent the window pane. One of the novel features of the present invention is a configuration which permits relatively simple modification for other applications. By way of example, for one such application, the channel clip of the present invention may be modified by cutting the retaining member which is farthest from the countersunk hole, while leaving the remaining retaining member and the portion of the base member that was formerly between the retaining members. The remaining base member portion is used as a base for supporting the decorative panel for continuing to provide a support base underlying the decorative panel. In another such modification, the configuration of the channel clip of the present invention may be modified by cutting that portion of the base member which extends beyond the first retaining member, that is the retaining member closest to the tapered or countersunk hole, thereby permitting retention of the designer panel without supporting it on the underlying base member. Thus, installation of a decorative panel using the present invention, may be easily accomplished with either all uncut channel clips or a combination of cut and uncut channel clips. The uncut channel clips may be used to secure the sides and top of the decorative panel and the cut channel clips being used to secure the base thereof or the decorative panel may be installed using all modified channel clips, depending upon the nature of the installation. Simple and easy modification of the channel clips of the present invention is therefore deemed to be an inventive feature thereof.

OBJECTS OF THE INVENTION

It is therefore a principal object of the present invention to provide a channel clip to hold glass or plastic designer or decorative panels in front of single or dual pane windows without affecting the existing window glass.

It is an additional object of the present invention to provide a channel clip to facilitate installation of designer panels in spaced parallel relation to the inner-most pane of existing windows, without requiring an abutting relationship between the designer panel and such window pane.

It is still an additional object of the present invention to provide a channel clip for installation of artistic panels adjacent to the inner-most pane of an existing window assembly by using a plurality of such channel clips, each designed to support such an artistic panel in parallel spaced relation to the inner-most pane of the window assembly to permit an air gap to exist between the artistic panel and the inner-most window pane.

It is still an additional object of the present invention to provide a channel clip to hold a glass or plastic panel in front of a single or dual pane window assembly, the channel clip having a readily modifiable configuration which may be readily made by simply cutting a portion of the clip along a single straight line.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which:

FIG. 1 is an isometric view of a preferred embodiment of the channel clip of the present invention;

FIG. 2 is an isometric view of the channel clip embodiment shown in FIG. 1, illustrating the manner in which the invention may be used to support a panel of plastic or glass;

FIG. 3 is a partially cross-sectioned side view of a window pane assembly, showing the use the channel clip of the present invention for mounting a panel of glass or plastic in parallel spaced relation to the inner-most pane of a dual pane window;

FIG. 4 is an isometric view of a first modification of the present invention;

FIG. 5 is an isometric view of a second modification of the present invention;

DETAILED DESCRIPTION OF A PREFERRED EMBODIMENT

Figure 6:
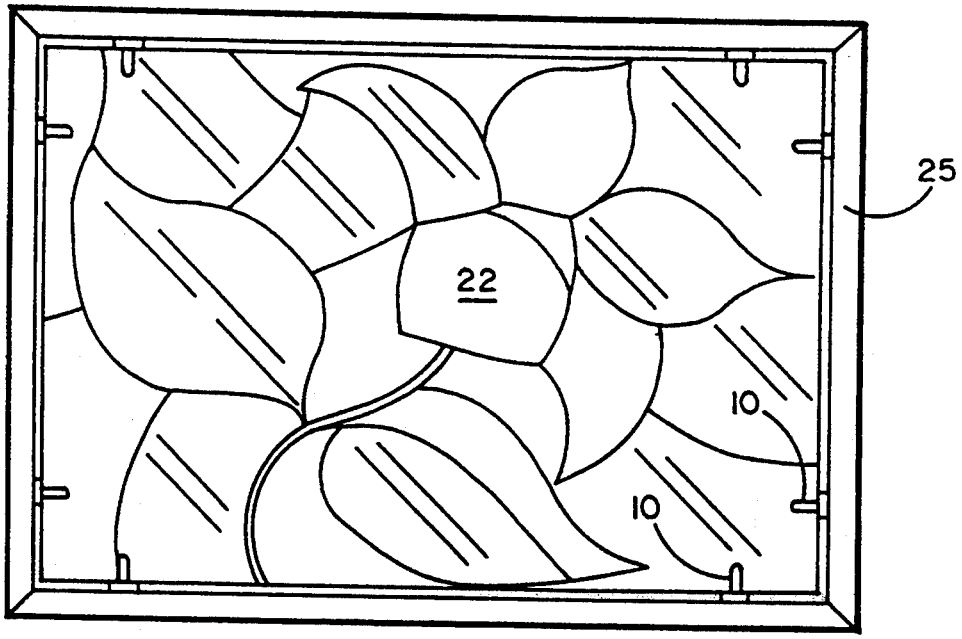
FIG. 6 is an elevational view of a typical window assembly shown having an additional panel installed therein by means of the present invention.

Referring now to FIGS. 1, 2 and 3, it will be seen that a channel clip 10 in accordance with the present invention comprises a base member 12 and a pair of retaining members 14 and 16, the latter being in a parallel, spaced apart relation and having a gap 18 therebetween which may be provided in suitable standard widths for accepting standard thickness panels. Base member 18 is of an elongated configuration, having retaining member 16 at one end and having a tapered or countersunk hole 20 at the other. Channel clip 10 is preferably formed of a rigid, substantially transparent material, such as clear polycarbonate plastic which may be injection molded into the shape shown in FIG. 1. The substantial transparency of the material is preferred in order to avoid interfering with the aesthetic appearance of a designer panel, such as panel 22 shown in FIG. 2 in the installed configuration.

A typical installation using the present invention is shown in FIG. 3. As seen in FIG. 3, a channel clip 10 of the present invention is employed to mount a glass panel 22 in spaced parallel relation with a pair of panes 26 and 28 of a dual pane window. In a typical configuration, the two panes 26 and 28 are held in place by a conventional aluminum window frame 30. Aluminum window frame 30 is secured between an exterior stucco surface 32 and an interior wall 36 and may conventionally be part of a horizontal surface which includes a dry wall surface 34 which abuts the aluminum window frame 30 and forms a sill for the dual pane window. In the typical installation shown in FIG. 3, the channel clip 10 is one of several secured along the edges of the panel 22 for retaining the panel in the desired position relative to the window panes 26 and 28. The particular channel clip shown in FIG. 3 is one of the bottom clips and as shown therein is secured to the underlying dry wall 34 by means of a suitable screw or other fastener 24 which extends through the countersunk hole 20. As seen further in FIG. 3, the retaining member 16 is positioned in an abutting engagement with the interior vertical surface of the aluminum window frame 30 and the panel 22 is positioned between the two retaining members 14 and 16. This installation configuration positions the designer panel 22 in parallel spaced relation to the inner pane 26 of the window, thereby leading an air gap 38 between the newly installed panel 22 and the existing window pane 26.

As seen in FIGS. 4 and 5, the channel clip of the present invention can be readily modified to provide other configurations which may also be used for installing a designer panel or the like in an existing window frame adjacent or in contact with the inner-most window pane. Thus for example, FIG. 4 illustrates a configuration 40 wherein the retaining member 16 has been removed by a single cut while leaving the portion 18 of base member 12 that formerly occupied the gap between the two retaining members 14 and 16. This first modification of the preferred embodiment of the present invention is most suitable for use in installing designer panels where it is desired to obviate the air gap between the designer panel and the inner-most panel of the existing window assembly, but while still providing an underlying support surface, namely portion 18 of the base member 12 to contact the edge of the designer panel. Still an additional modification of the present invention is shown in FIG. 5, wherein a modified configuration 42 of the present invention utilizes a single cut to remove not only the retaining member 16, but also the portion 18 of base member 12 which remained in the configuration 40 of FIG. 4. The modification of the present invention shown in FIG. 5 is suitable for installing designer panels where it is not necessary to provide an underlying base support for the edge of the panel and where it is desired to obviate the gap between the designer panel and the inner-most pane of the existing window assembly.

Figure 7:
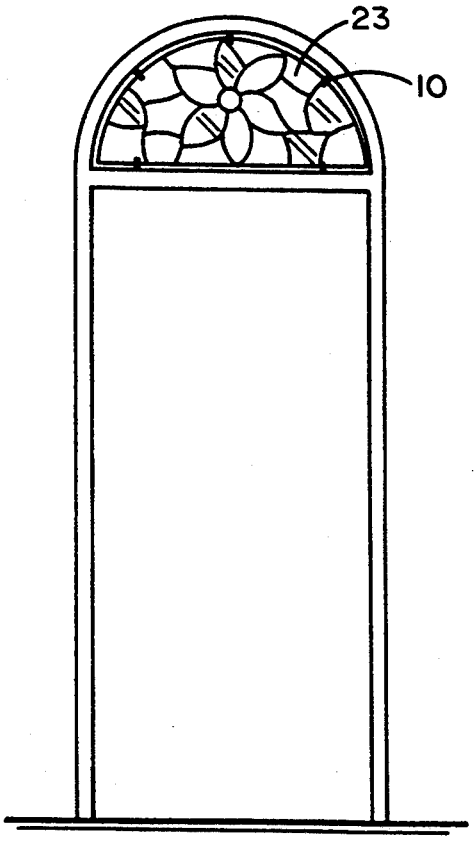
FIG. 7 is an elevational view of an additional example of a panel installation using the present invention.

Two examples of installations using the present invention are shown in FIGS. 6 and 7, respectively. In FIG. 6, the designer panel 22 is installed with a plurality of channel clips 10, namely two along each edge of a rectangular shaped designer panel 22 and within a window frame 25. FIG. 7 illustrates an alternative configuration wherein the designer panel is installed above an entry door. The panel 23 is of a semi-circular shape having a pair of channel clips 10 of the present invention securing the bottom straight edge of the panel and three such clips securing the semi-circular edge of the panel 23.

It will now be understood that what has been disclosed herein comprises a novel channel clip, primarily designed for use in installing glass or plastic decorative, designer or artistic panels in front of single or dual pane windows, without affecting existing window glass. The channel clip of the present invention is especially designed for use in securing an artistic pane or panel to an existing window assembly in spaced parallel relation to the inside surface of the window pane. It comprises an elongated base member having a screw hole at a first end, a first retaining member integral to the base member and extending perpendicularly to the base member at a second end of the base member and a second retaining member integral to the base member and extending perpendicularly to the base member parallel to and spaced from the first retaining member to form a gap between the first and second retaining members. The gap is substantially equal to the thickness of the artistic pane, secured by the channel clip. In a preferred embodiment of the invention, the channel clip is made of a substantially transparent material, such as a molded polycarbonate plastic. The preferred embodiment of the invention described herein may be deemed to be shaped in a configuration of the letter "F" when viewed from one side of the base member. The screw hole is preferably tapered to receive a countersunk screw and has an axis parallel to the retaining members. The present invention thus provides a convenient standard device for installing designer panels in spaced relation to the inner panel of an existing window assembly to provide an air gap therebetween which prevents temperature changes, such as those incurred during the peak summer months, from detrimentally affecting the structural integrity of designer panels, such as stained glass panels and the like.

Those having skill in the art to which the present invention pertains, will now as a result of the applicant's teaching herein, perceive various modifications and additions which may be made to the invention. Thus, while a specific shape and material has been disclosed herein for a preferred embodiment of the invention, other shapes and materials suitable for use in the manner proposed herein, will now become apparent to those having the benefit of the applicant's disclosure. Accordingly, all such modifications and additions are deemed to be within the scope of the invention which is to be limited only by the claims appended hereto and their equivalents.

I claim:

1. The combination comprising:

an artistic pane having exterior edges and being installed in an existing window assembly in spaced parallel relation to an inside surface of the pane of the existing window assembly; and a plurality of light transmissive channel clips, each such clip being secured to an exterior edge of said artistic pane; each such clip having an elongated base member with a screw hole at a first end and a pair of parallel, spaced-apart first and second retaining members integral to said base member and extending perpendicularly from said base member adjacent a second end thereof; a gap being formed between said first and second retaining members, said gap being substantially equal to the thickness of said artistic pane at said exterior edges for securing each said channel clip to said artistic pane.

2. The combination recited in claim 1 wherein said base member and said first and second retaining members are made of a substantially transparent material.

3. The combination recited in claim 2 wherein said transparent material is a polycarbonate.

4. The combination recited in claim 1 wherein said base member and said retaining members are shaped in a configuration of the letter "F" when viewed from one side of said base member.

5. The combination recited in claim 1 wherein said screw hole is tapered to receive a countersunk screw and has an axis parallel to said retaining members.

* * * * *